US006477881B2

(12) United States Patent
Eloriaga et al.

(10) Patent No.: US 6,477,881 B2
(45) **Date of Patent: *Nov. 12, 2002**

(54) MODULAR SYSTEM FOR SEAMING METAL SHEETS

(75) Inventors: Mike Iraragorri Eloriaga, Gorliz (ES); Teodoro Zubia Zaldua, Bilbao (ES); José Ramón Zulueta Galindez, Leioa (ES); Elias Garcia Sanchez, Leioa (ES); Santos Casa Hoyos, Guriezo (ES)

(73) Assignee: Matrici S. Coop., Zamudio (ES)

( * ) Notice: Subject to any disclaimer, the term of this patent is extended or adjusted under 35 U.S.C. 154(b) by 0 days.

This patent is subject to a terminal disclaimer.

(21) Appl. No.: 09/987,105

(22) Filed: Nov. 13, 2001

(65) Prior Publication Data

US 2002/0026819 A1 Mar. 7, 2002

Related U.S. Application Data

(63) Continuation of application No. 09/600,668, filed as application No. PCT/ES99/00272 on Aug. 23, 1999, now Pat. No. 6,314,784.

(30) Foreign Application Priority Data

Nov. 20, 1998 (ES) ..... 9802437

(51) Int. Cl.[7] ..... B21D 39/02
(52) U.S. Cl. ..... 72/323; 72/322; 29/243.58
(58) Field of Search ..... 72/323, 322, 316, 72/386, 384, 312; 29/243.58, 243.57

(56) References Cited

U.S. PATENT DOCUMENTS

| | | | | |
|---|---|---|---|---|
| 3,092,057 | A | 6/1963 | Warshilek | |
| 3,130,770 | A | 4/1964 | Tribe | |
| 3,142,329 | A | 7/1964 | Tribe | |
| 4,006,518 | A | 2/1977 | Rudolph et al. | |
| 4,596,415 | A | 6/1986 | Blatt | |
| 4,901,555 | A | 2/1990 | Shimoichi | 72/322 |
| 5,005,398 | A | 4/1991 | Evans | 72/450 |
| 5,050,422 | A | 9/1991 | Dorsett | 72/450 |
| 5,454,261 | A | 10/1995 | Campian | 72/323 |
| 5,457,981 | A | 10/1995 | Brown et al. | 29/243.58 |
| 5,746,083 | A | 5/1998 | Kovarovic et al. | 72/312 |
| 5,876,315 | A | 3/1999 | Azema | |

FOREIGN PATENT DOCUMENTS

| | | |
|---|---|---|
| DE | 1 452 618 | 4/1969 |
| EP | 0 820 822 | 1/1998 |
| EP | 0 924 005 | 6/1999 |
| FR | 1 322 218 | 2/1963 |
| FR | 1 445 675 | 6/1966 |
| FR | 2 651 699 | 3/1989 |
| FR | 2 774 011 | 7/1999 |
| GB | 232490 | 4/1925 |
| GB | 787513 | 12/1957 |

*Primary Examiner*—Daniel C. Crane
(74) *Attorney, Agent, or Firm*—Browdy and Neimark, P.L.L.C.

(57) ABSTRACT

A modular system for seaming and a headstock to perform it, that has a structure, a table (2) and a cradle (1) on which the parts to be machined are supported. It includes a slide that moves in a linear manner (6) and that includes the tools, which are mounted on a tool holder that turns on a shaft on the body of the moving slide, and towards the parts to be seamed. It permits the seaming of both internal and external contours.

10 Claims, 12 Drawing Sheets

FIG. 9
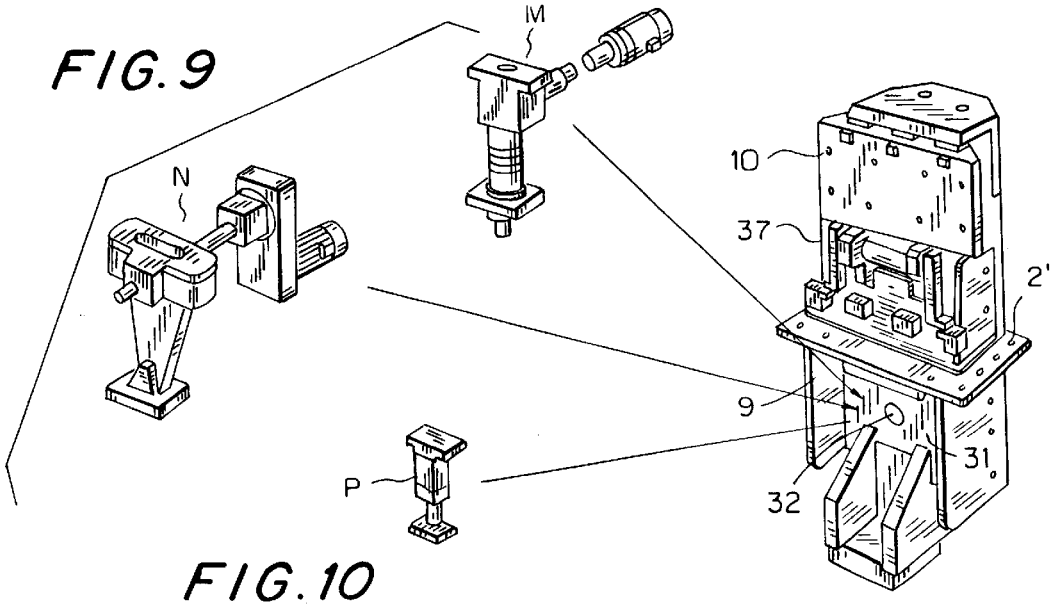
FIG. 10
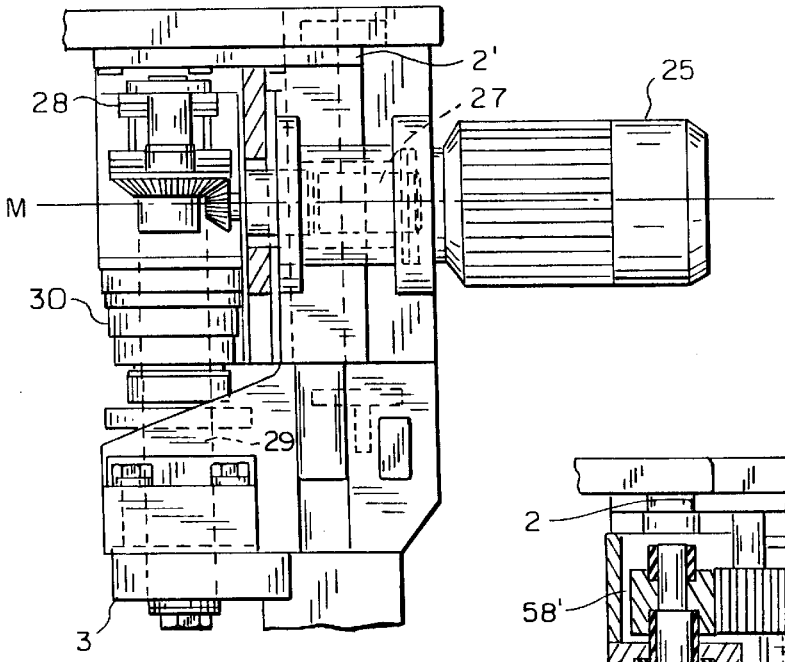
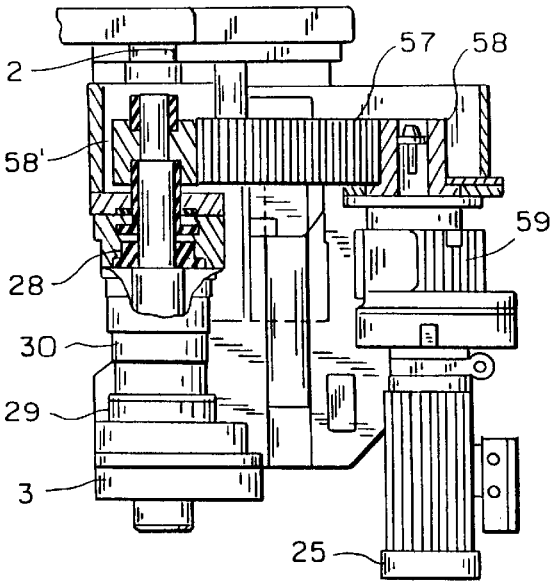
FIG. 10A

MODULAR SYSTEM FOR SEAMING METAL SHEETS

This is a continuation of parent application Ser. No. 09/600,668, now U.S. Pat. No. 6,314,784, filed Jul. 20, 2000 which is a 371 of PCT/ES99/00272 filed in Aug. 23, 1999.

BACKGROUND OF THE INVENTION

1. Technical Field of the Invention

This invention relates to a modular system for seaming (also known as welting, locking or cramping) and a headstock to perform the seaming, aimed at carrying out the union of two or more metal sheets by means of the folding of one of them, which is previously prepared.

2. Prior Art

Seaming headstocks applicable to this technique are known, according to which the joining of the metal parts to each other is carried out by means of a first fold of a flange or lip on one of the two parts over the other and a second fold of this said flange or final fold.

Within this field, the existence of references U.S. Pat Nos. 3,130,770, 3,142,329, FR-A-2,651,699, DE-A-1,452,618, U.S. Pat. No. 5,457,981 and EP-A-0820822 is known, which usually have headstocks connected to structural assemblies, with a structure itself, a base plate, a work table or desk on which the parts to be seamed are placed, and a treader plate.

In the same way, in these references, the headstocks include the work tools for the folding operations, and these headstocks are equipped with two types of movement, one rotation movement by which all the headstock is turned on approaching the work point, and another sliding movement or closer approach of a unit connected to the headstock that holds the tools.

These known headstocks usually also have mechanical stops in their practical embodiment and their way of working is applied to external contours (or profiles) or to internal contours, depending on the cases.

All the techniques shown by the references mentioned above have several disadvantages discussed below.

Reference U.S. Pat. No. 3,130,170 has the disadvantage, among others, that the headstock is not fixed but that it turns in relation to the parts to be worked, which means the occupation of a considerable useful space; it performs the seaming of external contours only; it does not have mechanical work stops nor cradle tool anti-collision safety. The pre-operation tool does not work perpendicular to the part, and it does not have a safety locking system.

Reference U.S. Pat. No. 3,142,329 has the following disadvantages: the headstock has a turning movement in relation to the parts; it does not have mechanical stops; it is not prepared to work with several tools; it performs the seaming of external contours only. The pre-operation tool does not work perpendicular to the part, and it does not have a safety locking system.

Reference FR-A-2,651,699 suffers from the lack of adjustable mechanical stops and it is not a worktop system; it only performs the seaming of external contours.

Reference DE-A-1,452,618 has the disadvantage that the pre-operation is carried out with lateral movement, not perpendicular to the part; it does not have adjustable mechanical stops; it performs the seaming of external contours only and it does not have mechanical stops for cradle tool anti-collision safety or a safety locking system.

Reference US-A-5,457,9S1 is configured with a general headstock that turns in relation to the position of the parts to be worked; it does not have adjustable mechanical stops and it is prepared for seaming external contours only. Besides, it lacks a safety locking system.

Reference EP-A-0,820,822 has a headstock that turns in relation to the position of the parts to be worked; the mechanical stops are integrated into the tool; it is only without mechanical stops for anti-collision safety and it needs items external to the headstock in order to carry out the turning on approach to the part and it lacks a safety locking system.

SUMMARY AND OBJECTIVE OF THE INVENTION

The fundamental objectives of the present invention are to provide a seaming system with a worktop in which the parts to be seamed remain static, by means of the following:

- A fixed headstock provided with sliding—in line movement which the tools have a work-approach movement to the parts to be seamed.
- The work tools are located on a common plate and are adjustable.
- There are double mechanical stops in all operations.
- It is prepared to perform seaming of both external contours and internal contours.
- It can perform the seaming in two or three operations, one or two for pre-operation and one for finishing.
- It can work with several tools on one single headstock.
- It can include several different drive systems to be installed in the headstock.
- It includes cradle tool mechanical anti-collision stops.

BRIEF DESCRIPTION OF THE DRAWINGS

Apart from these basic objectives of the invention, others derived from it can be observed with the assistance of the accompanying sheets of drawings, in which the following are represented, without any restrictive character whatsoever.

FIG. 9 represents, in a perspective view, the headstock of the invention together with the three drive system possibilities.

FIGS. 10 and 10A are details of the electromechanical drive system for the headstock.

DETAILED DESCRIPTION OF THE PREFERRED EMBODIMENT OF THE INVENTION

Figure 1:
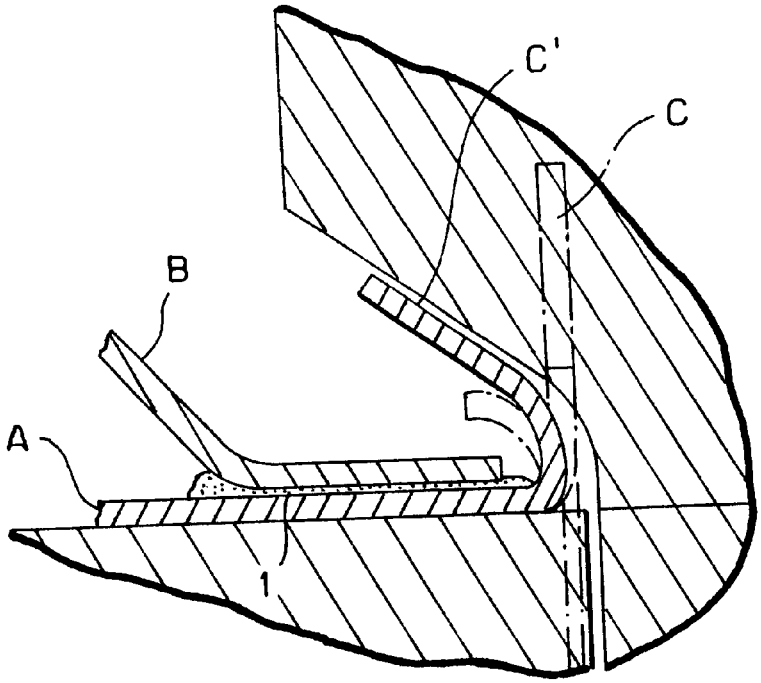
FIG. 1 shows the parts to be connected to each other in accordance with the invention in a first work or preparatory operation.
Figure 2:
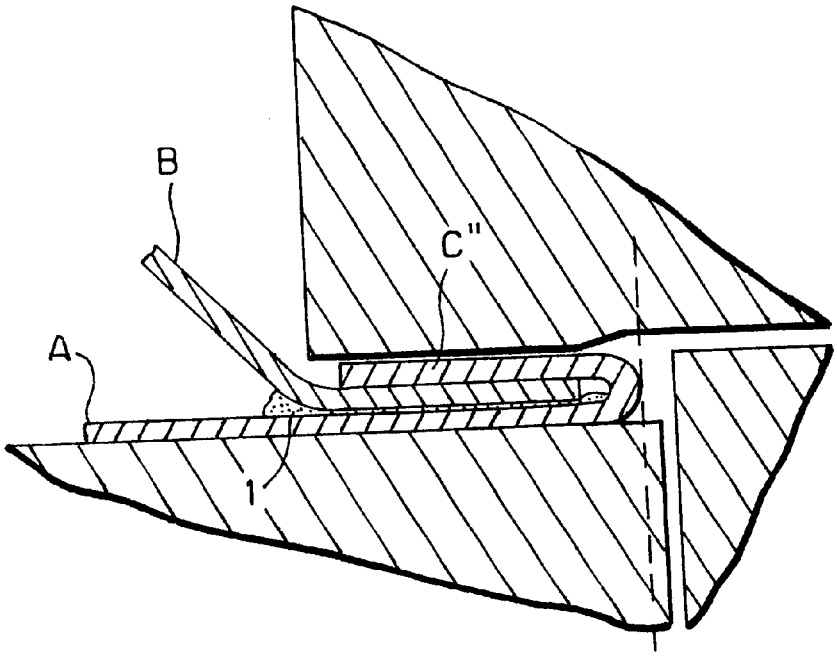
FIG. 2 represents the termination of the seaming operation of the parts shown in FIG. 1.

In accordance with the contents of the preceding figures and for the putting into practice of the objectives foreseen by the invention, it is first emphasized that, in accordance with FIGS. 1 and 2, two parts (A) and (B) are represented, to be seamed or cramped together by means of the folding of the wing or fin (C) of the first of these over the second, from its initial position (C) to one or more intermediate positions (C'), depending on whether it is carried out in one or two operations, and from the said intermediate position, in another later operation, to the final position (C").

Several tools are used in order to carry out these operations, as shown in FIGS. 3 to 6, so that the seaming can be carried out in one, two or three operations in the same cycle, depending on the cases, for which the particulars will be described later.

Figure 7:
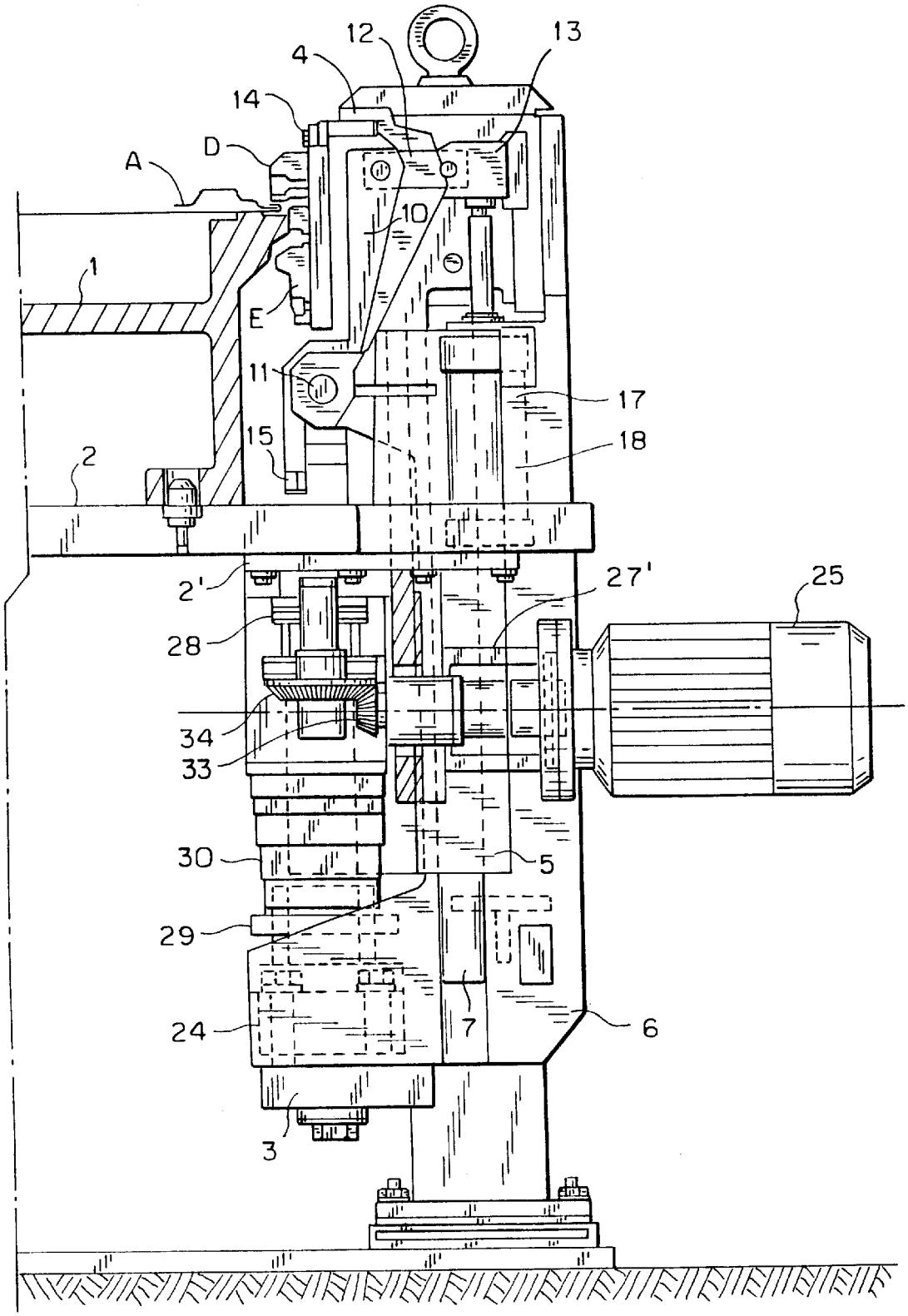
FIG. 7 shows an elevation of the headstock of the invention with an electromechanical drive system.

In accordance with FIG. 7, we can appreciate the seaming module mounted on a structure in which a table (2) or base plate of the machine participates and acts as a structure for the machine and supports the headstock and a cradle (1) to support the parts to be seamed. The plate (2') of the headstock is supported on the table (2) by bolting to it, and this plate is connected to the fixed supports (5) at both sides of the headstock, and to the plates (31) and (9) show in FIG. 9.

A slide (6) moves on these two fixed side supports (5) by means of guides (7), so that this slide can be moved, in this case upwards and downwards, in relation to the table (2).

The slide includes some mechanical stops (15) and (16) mounted on the base plate (2), and on the lower face or side of this base situated a plate (9) to which the drive system for the slide is secured, including this slide (6), in its lower portion, a pusher plate (3) fundamentally parallel to the securing of the drive systems. Between both plates are arranged the different drive systems that cause the movement of the slide (6). The plate (9) is appreciated in FIG. 9.

The slide is in turn integral to an upper work head, on which a tool holder plate (10) is arranged, that turns on the shaft (11) and that holds tools (D, E) in order to work the parts (A).

The tool holder (10) is connected to a connecting rod (12) and this is connected to a slide (13) that, moving vertically due to the action of the cylinder (17, 18), can make the plate (10) move forward to the work position, as shown in this FIG. 7, or move back to allow the sliding movements of the headstock.

Between the fixed supports (5) there is a wall (31) perpendicular to the said supports and integrally connected to them, and on this wall are situated the drive mechanisms arranged between the pusher plate (3) and the holder plate (2'). This vertical wall (31) is provided with a hole (32) in order to facilitate the passage of the said mechanisms, exactly as illustrated in FIG. 9, for instance.

In the case of the said FIG. 7, the drive is carried out starting from a motor (25) whose shaft outlet is connected to the hub and flexible coupling (27), after which the conical pinion (33) can be appreciated, which secures the conical crown gear arranged on a vertical shaft located between the holder plate (2') and the pusher plate (3), with the upper provision of the roller bearing set (28).

The shaft is covered by a bellows (30) and in the lower part a screw spindle and ball nut (29) are shown, as well as an elastic packing (24), so that the turning of the screw spindle in the ball nut will cause the raising of the pusher plate (3) and, more specifically, of the slide (6).

As regards this FIG. 7, it must be pointed out that the headstock is to be found in the position at the end of the seaming operation, with the tool holder plate (10) butting up against one of the mechanical stops (15). The operation of the stops will be explained later.

Figure 8:
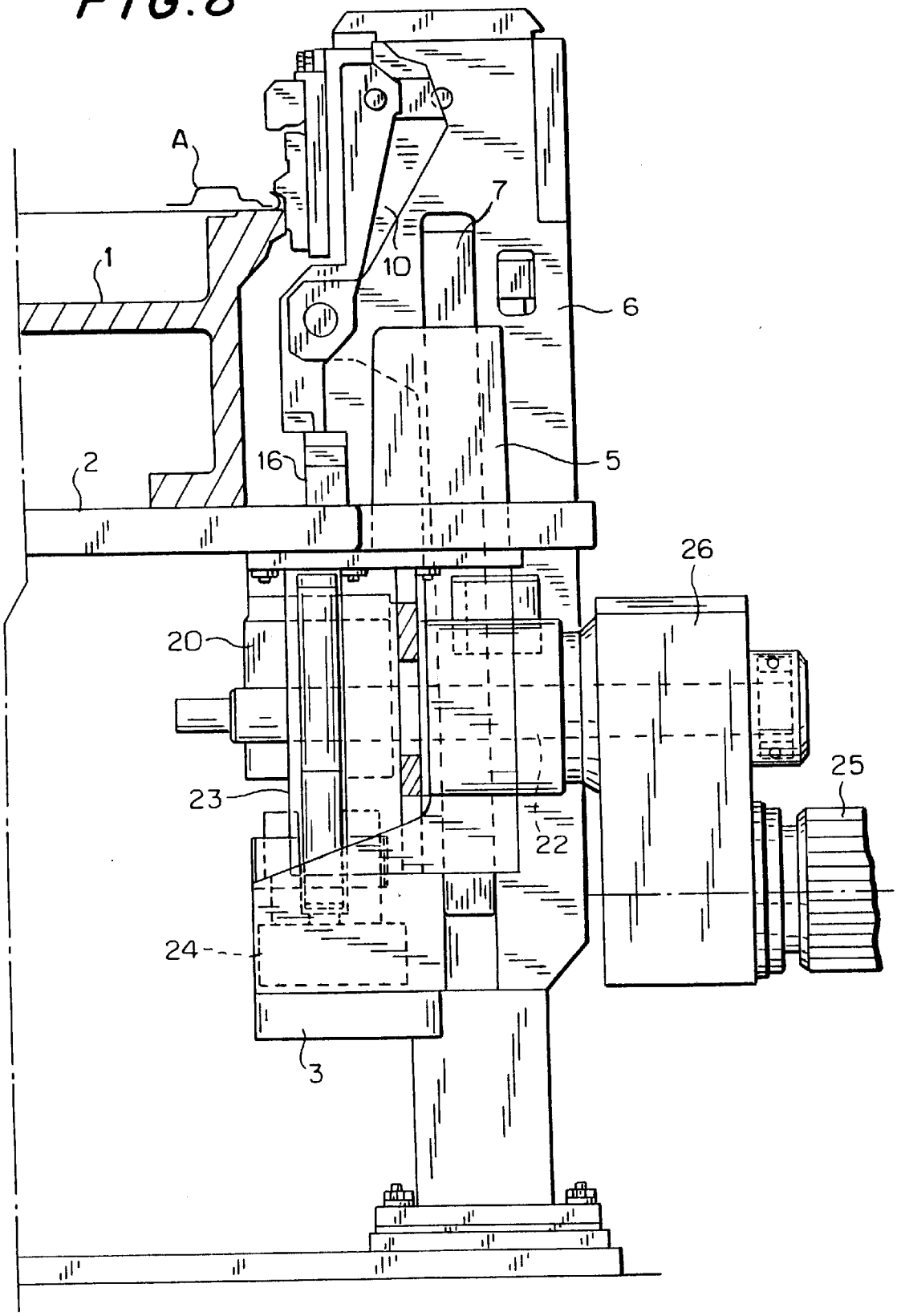
FIG. 8 is a valiant of the headstock shown in the previous Figure, equipped with a mechanical box and an electrical drive system.

The drive system in FIG. 8 is composed of a motor (25) and a reducer (26) that drive a main shaft (22) connected to a connecting rod (23), which, by means of the elastic packing (24) is connected to the pusher plate (24) and all this assembly is included in the mechanical box (20).

In accordance with this representation shown in FIG. 8, the slide (6) is to be found in the intermediate work position in relation to the machining of the parts, as can be appreciated, in which position the tool holder plate (10) makes contact with the mechanical stop (16).

In FIG. 9, the perspective of the seaming module (37) is shown clearly, with the tool holder plate (10) and the plate (2') for holding the part to the table and the fixed supports (5). Below the plate (2') we can observe the position of the plate (9) for holding the drive systems, to be situated between itself and the lower pusher plate (3), using the plate (31), perpendicular to the supports (5) and the hole (32), depending on which type of drive system is used.

In the case of the drive systems (M), electromechanical, and (7) (N), mechanical box, it is evident that the assistance of the plate (31) and hole (32) become necessary, whereas it will not be necessary when the said drive is carried out by the unit (P), for whose provision the plates (9, 3) are sufficient.

Figure 11:
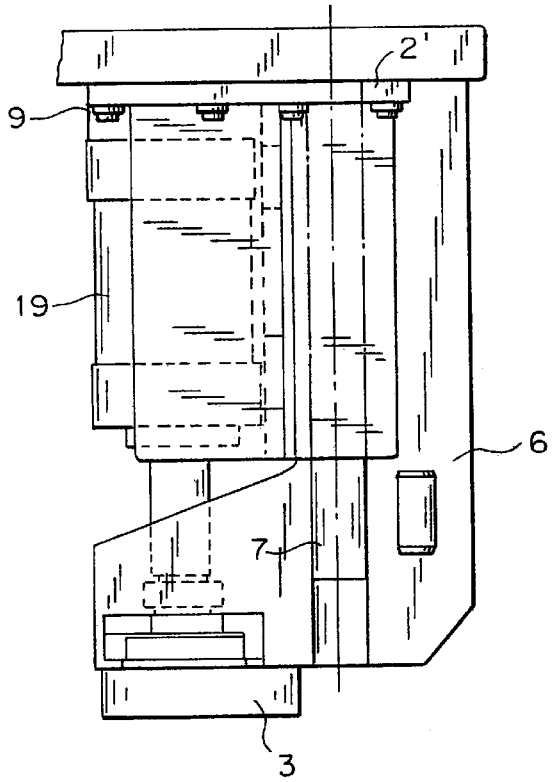
FIG. 11 is a detail of the drive system for the headstock through the hydraulic cylinder.
Figure 12:
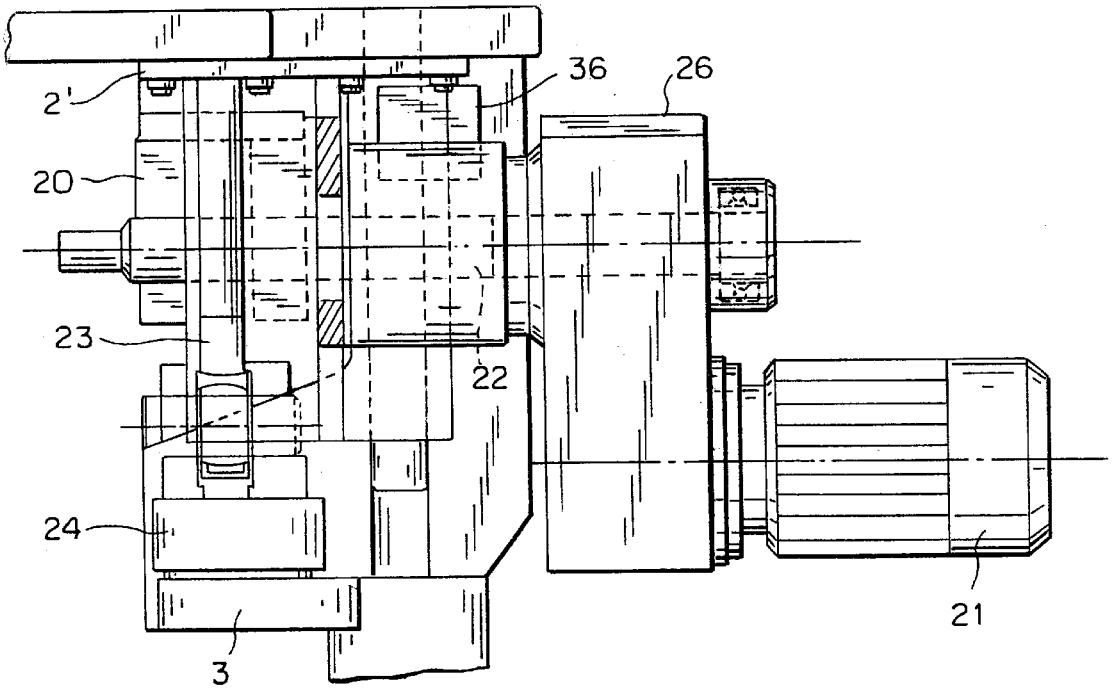
FIG. 12 corresponds to the detail of the drive system for the headstock through a mechanical box with an electric motor.

These three assemblies are shown individually in FIGS. 10, 11 and 12, two of which were already shown in FIGS. 7 and 8, and now paying more attention to the assembly of the drive system based on the hydraulic cylinder (19) housed in the space prepared between the plates (9) and (3).

Figure 13:
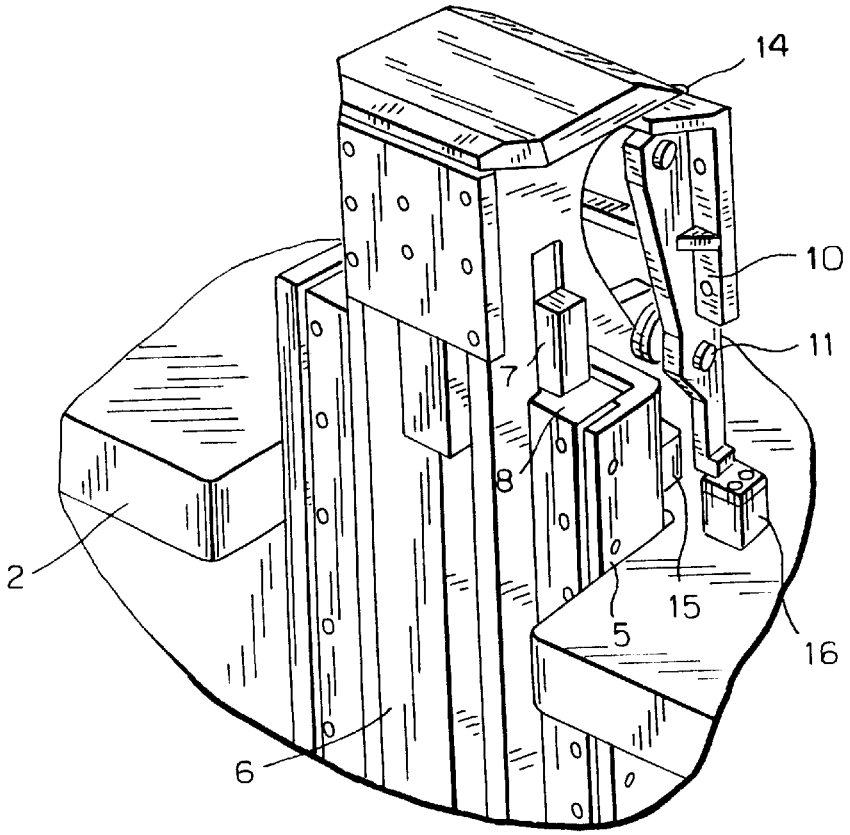
FIG. 13 shows the upper rear part of the headstock in accordance with the invention.

The arrangement of the fixed supports (5) in relation to the holder plate (2') and the table (2) are perfectly defined in FIGS. 9 to 13, where the moving slide (6) and its guides (7) that move along the slide square plate (8). In FIG. 13, we emphasize the tool holder plate (10) that turns on the shaft (11) and is limited in this case by the pre-seaming stop (16), situated next to the seaming stop (15).

Figure 14:
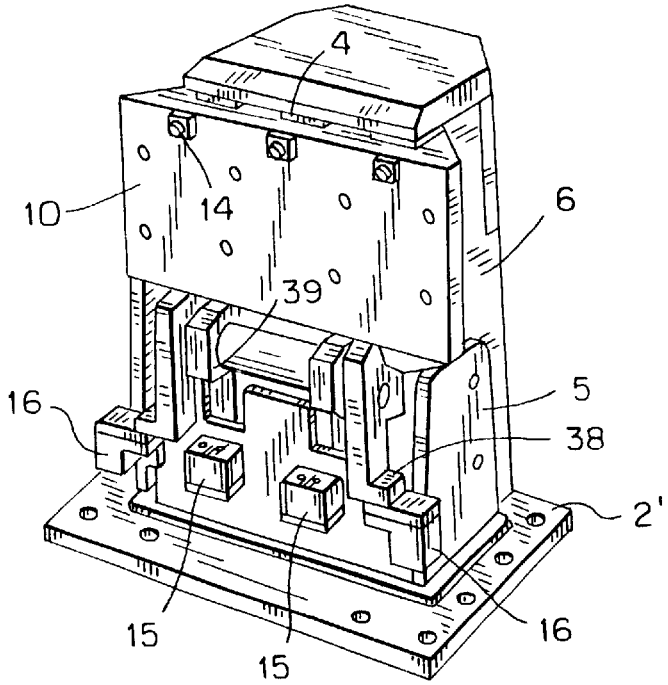
FIG. 14 is an enlargement of the upper front part of the headstock, showing the mechanical stops.

In the same way, the front face of the upper part of the headstock shown in FIG. 14 allows us to observe the front portion of the tool holder plate (10) on which the machining tools are fixed, with the dollies (4) and the eccentric stops (14) in order to adjust the height of the tool. The position illustrated corresponds to that of FIG. 8, according to which the headstock is to be found in the pre-seaming situation, with the prolongation of the tool holder (19) supported on the stop (16).

The two seaming stops (15) will make contact with the prolongations on the slide (6) shown according to the position in FIG. 7.

The specific geometry carried out on the pre-seaming fixed and mobile (16)(38) stops also carried out the function of anti-collision security between the tools and the part support cradle.

Figure 15:
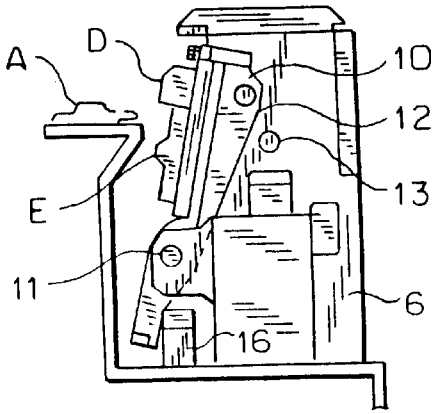
FIGS. 15 to 18 represent the sequences of the work operation of the headstock in the part that includes the tools, in relation to the parts to be seamed.
Figure 16:
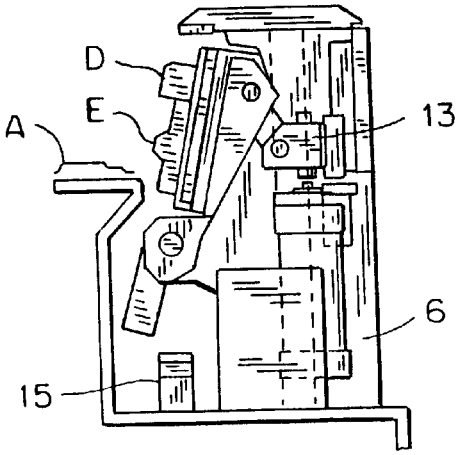

More specifically, the two external stops (16) correspond to the pre-seaming and the two internal ones (15) to the seaming, as implied by what is illustrated in FIGS. 15 to 18. In these, the beginning of the cycle is shown in FIG. 15, in which the slide (13) of the tool holder is to be found in its lowest position, so that the connecting rod (12) has pulled on the upper part of the tool holder plate (10), making it tilt in relation to the slide. Once that the slide has moved to the position of maximum elevation shown in FIG. 16, the tool holder plate (10) remains in the previous position but already at the height needed to carry out the pre-seaming.

Figure 17:
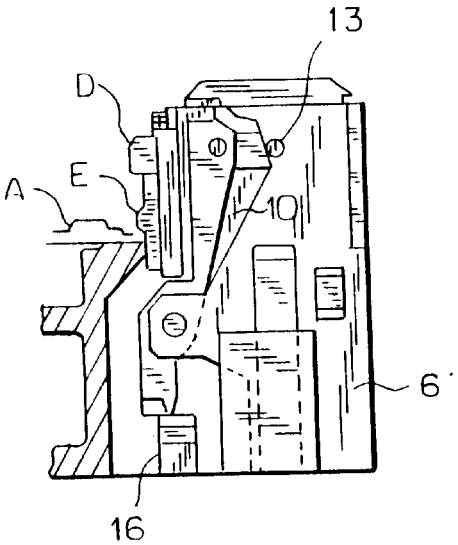

Once it is in this position, the slide (13) is driven upward so as to present the tools (D, E) in order to carry out the pre-seaming on the part (A). FIG. 17, with this pre-seaming being carried out specifically by the lower tool (E) at the same time as the slide (6) starts to come down.

Figure 18:
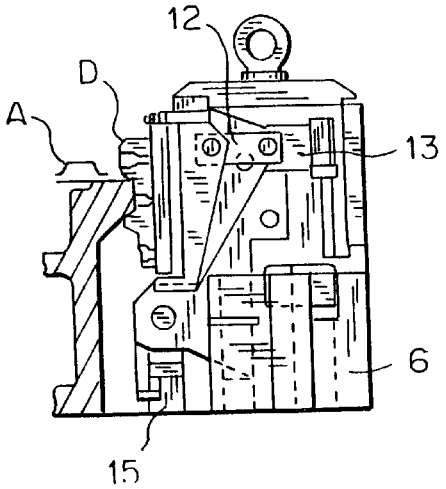

With this combination of movements, the sliding of the slide in one or other direction and the tilting of the tool holder plate (10) inwards and outwards, the final seaming is also carried out, as illustrated graphically by the position shown in FIG. 18.

The assembly or unit in the invention is logically prepared to synchronize the movements of the slide (6) and of the tool holder plate (10) for the purposes of carrying out all the work sequences that will be described in greater detail later.

Figure 19:
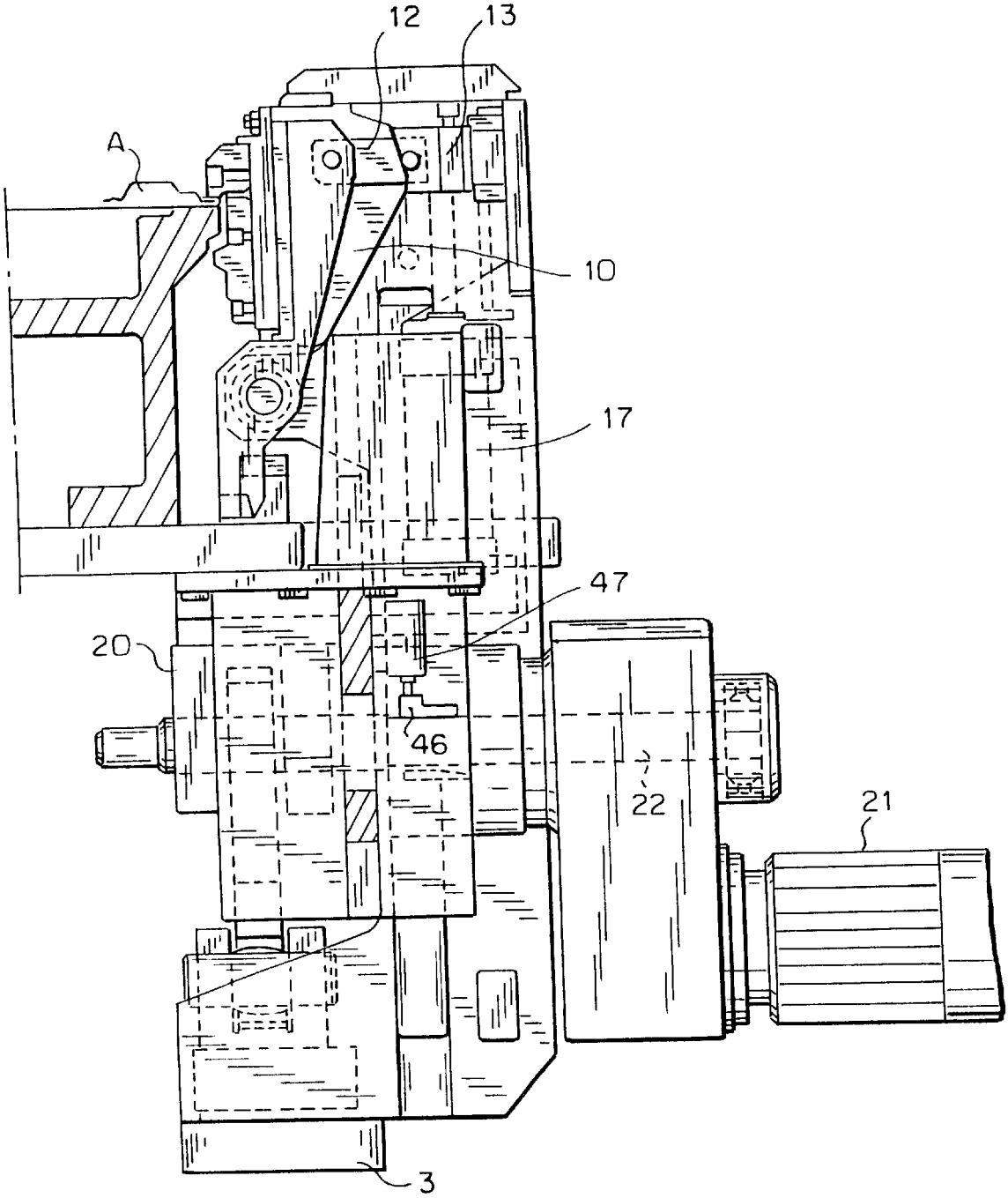
FIG. 19 illustrates the synchronized drive system for the modular headstock based on a cam and a pneumatic distributor, in accordance with the invention.

The synchronization can be carried out by any conventional means so that the movements of the slide (6) are adapted to those of the tool holder plate (10) and, to this effect, FIG. 19 provides one possibility of this synchronization.

Therefore, in FIG. 19, the headstock is equipped with a mechanical box (20) and electric drive for the traverse or work movement of the slide (6) and a pneumatic cylinder (17) in order to provide the tool insertion/removal drive. The cylinder (17) by means of the cam (46) installed on the main shaft (22) of the mechanical box, with this cam actuating a mechanically controlled pneumatic distributor (47) that operates the cylinder (17). With this version, it is only necessary to control the electric motor (21) from the operating control of the machine.

Figure 20:
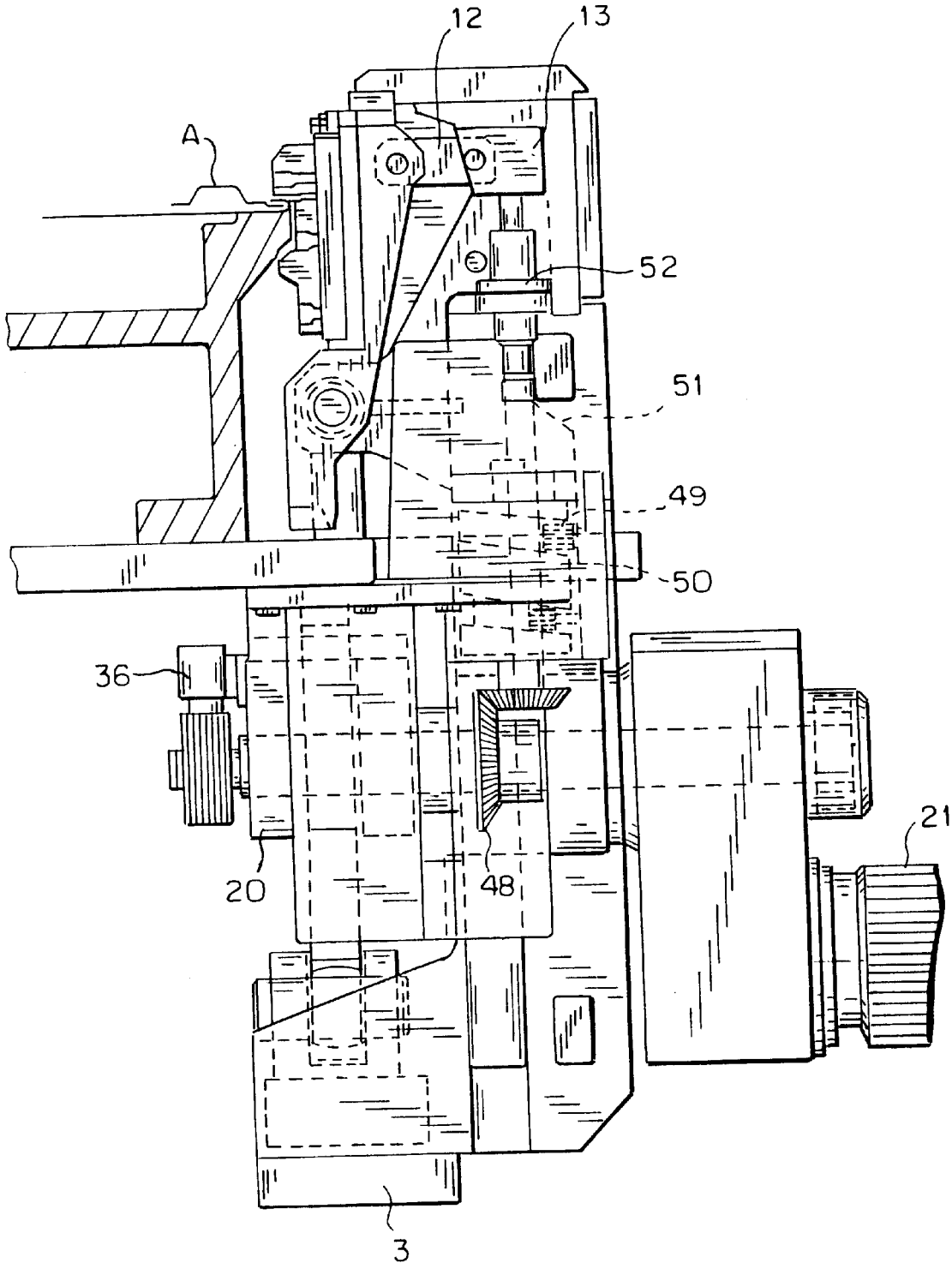
FIG. 20 also illustrates a synchronized drive system for the headstock, using a mechanical cam follower.

The assembly in FIG. 20 shows, on the main shaft (22), a conical gear or mitre gear (48) that provides movement to the cam follower (50) which is supported on two conical roller bearings and provides vertical movement in the arm (51) by means of the follower rollers (49). In the transmission of the movement to the upper slide (13) it has an elastic system (52) in order to compensate differences and give pre-load to the tools in the work position. In the same way, with this version, it is only necessary to control the motor (21) from the control centre of the machine.

Figure 21:
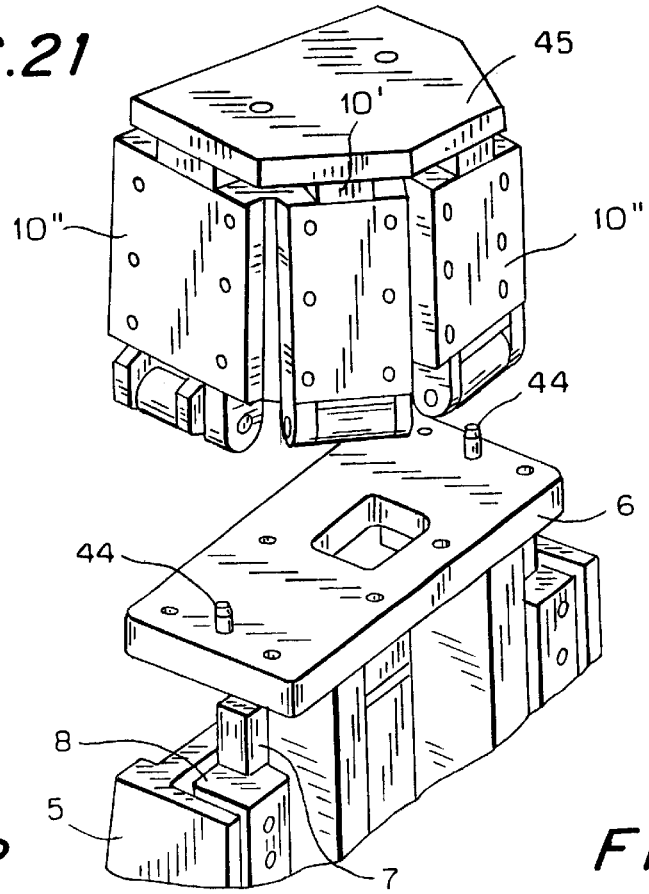
FIG. 21 shows the variant of a headstock with four tool holder plates.

Moreover, and as already commented on previously, the machine can work with one or several tool holder plates (10) operated simultaneously by the slide (13), as shown in FIGS. 21 to 24. In this case, a work head (45) is provided, with four tool holder plates (10', 10") by way of an independent unit connected to the headstock by means of bolts (44) on the headstock and their corresponding couplings, as shown in FIG. 21.

Figure 22:
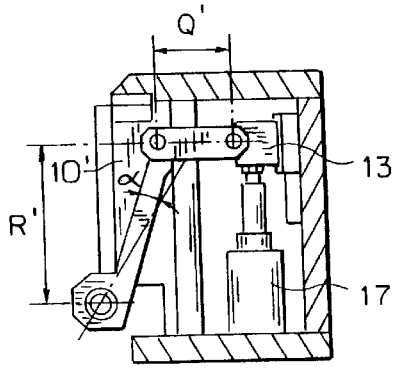
FIGS. 22 to 24 represent, and some in particular, the internal operation of the multiple headstocks shown in FIG. 21.
Figure 23:
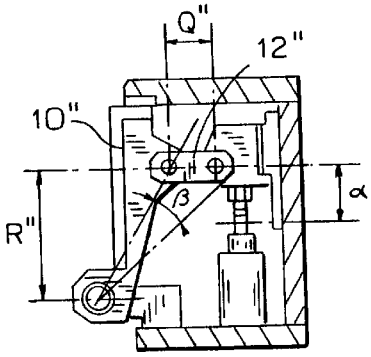
Figure 24:
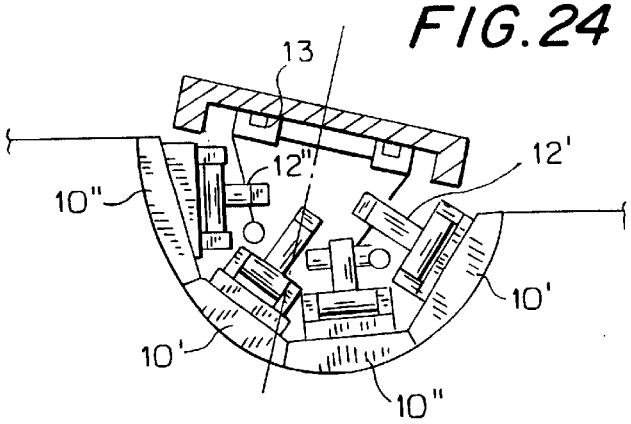

In FIGS. 22 to 24 we can observe how the four plates (10', 10") are arranged alternately, so that these plates have different behaviour in the folding, two by two. Thus, the plates (10') are connected to longer connecting rods (12'), whereas the plates (10") are connected to shorter connecting rods (12"), with which both groups of plates promote different folding angles so that the headstock can be removed without collisions between them.

It can be clearly appreciated in FIG. 22 how, for the travel or movement of the mobile slide (13), a slide which is the same for all the plates, a folding angle (a) is created, in terms of the dimensions (R', Q'), with this angle being different from the angle (β) of the plate (10") in FIG. 23 in terms of the different dimensions (R', Q'), and with the travel ( ) of the mobile slide being the same.

In this way, the plates (10") fold down more than the plates (10') because the angle (β) is greater that the angle (α), thus enabling the folding by the headstock without collisions between the tools, a circumstance which can be deduced from FIG. 24.

Figure 25:
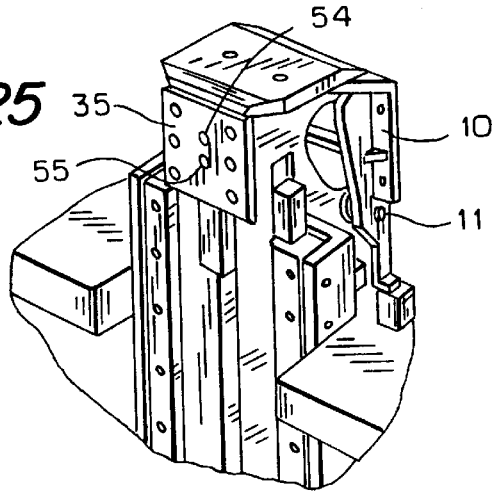
FIG. 25 illustrates the position of the rear holes in the headstock to carry out the locking of the unit.

The module in accordance with the invention is provided with locking in order to facilitate the assembly and maintenance operations of the head, in which this locking can be total or partial. This matter is defined in FIGS. 25, 26 and 27; in order to do this, the rear plate (35) has two holes (54, 55) made in it, through which a pin (53) can be housed that reaches the blocked hole (56) in the mobile slide (13).

Figure 27:
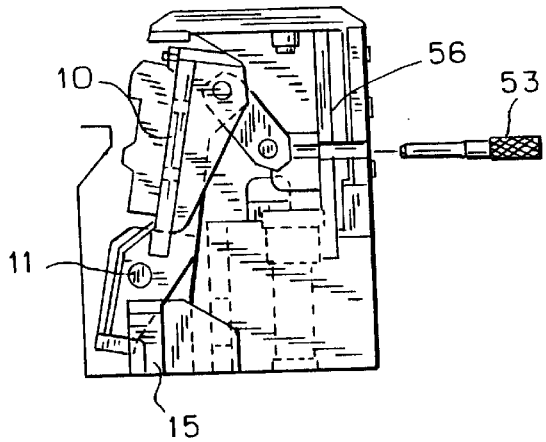
FIG. 27 represents the partial locking of the headstock.

For the partial locking FIG. 27' which is understood to mean preventing the entry movement of the tools, the pin (53) i5 housed in the lower hole (55) until the blocked hole (56) in the slide (13) is in its low position with the tools withdrawn, i.e. with the tool holder plate (10) lowered. In this situation, the tool holder plate (10) is locked.

Figure 26:
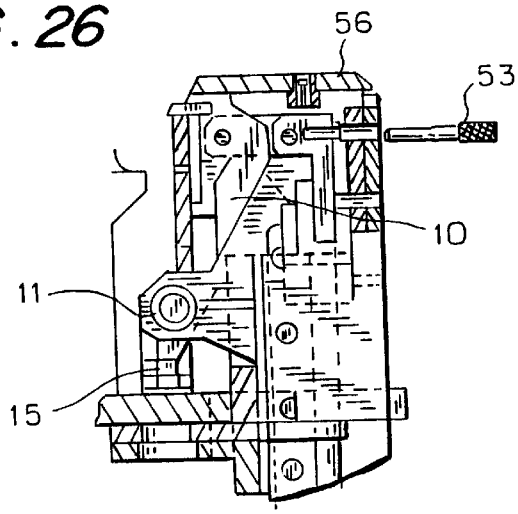
FIG. 26 represents, in an elevation, the total locking of the headstock.

For the total locking FIG. 26, with the tools in the work position and the slide (13) logically in its highest position, the pin is housed in the blocked hole (56) in the said slide, immobilizing the tool holder plate (10). Apart from this, the tool bolder plate makes contact with the stops (51) and the movement of the slide (6) becomes locked.

The movement of the slide, as mentioned up to now, is linear not only in the vertical direction described in the figures but also in any other direction that practice advises and, on the slide, the tool holder plate carries out the approach rotation movement to the part, to be machined, so that both movements combined carry our the seaming.

As regards the drive system in FIGS. 7 and 10, it is emphasized that for the movement of the tool holder plate (10), either a pneumatic cylinder (17) or a hydraulic one (18) can be installed, so that the shaft of these units moves the tool holder slide (13) linearly. This slide is guided by means of recirculating roller runners and has a mechanical stop in the work position.

The main function of the elastic system (24) is for the work position to remain even when the drive motor is stopped and prevent overloading of the system with forces higher than those predetermined for its connect operation.

The regulation of the speed and the force for the electromechanical drive is carried out in the power supply of the servomotor (synchronous motor with excitation by magnetic means of a converter with digital regulation.

In spite of the fact that this drive system requires a high installed power, due to its being a continuous drive and a complex electrical automatism, it has the advantage that it allows the seaming force to be regulated by means of a simple change of parameters in the regulation converter.

As regards the drive system by hydraulic cylinder, FIGS. 9(P) and 11 this is situated in a vertical static position with the piston rod oriented downwards. This static position simplifies the hydraulic connections and the maintenance tasks.

As for the drive system by a mechanical box and electric motor, in FIGS. 8 and 12, it is pointed out that electric or pneumatic motors can be fitted in the reducer (26) as the drive system, and their main advantages are that these motors use a power supply of approximately one third of that needed for continuous drives, regulate the speed mechanically, with maximum speed in traverse movements and optimum speed in each work operation, pre-seaming and final seaming.

This function of mechanical regulation enables the optimization the cycle times and also considerably simplifies the electric control automatism. Moreover, it allows the installation of two synchronized drive options for the movement of the tools, which simplifies the electric automatism even more, reducing cycle times.

With the synchronized versions shown in FIGS. 19 and 20, and as pointed out previously, it only becomes necessary to control the motor (21) from the handling control centre for the unit.

The general operation of the module starts its cycle with the headstock in its rest position. In a first operation, as suggested by FIGS. 15 to 18, the headstock rises until the pre-seaming tool or tools are at the appropriate work height for this operation. Next the tool holder turns, the tools are inserted and the pre-seaming takes place, with the slide then descending suitably and the tools being withdrawn again.

The slide continues to descend until it reaches the height of the tools corresponding to the seaming operation, the tool holder turns and the slide descends again in order to carry out the final seaming, so that one this has been completed, the slide rises and the tools are withdrawn again until the next cycle.

In these operations, the headstock makes contact with the appropriate mechanical stops, one of whose missions is to prevent the tools from coming into contact with the part support cradle, when a cycle is carried out without parts.

In the same way, due to its intervention, a uniform pressure is guaranteed in the seaming area or the maintaining of a constant pre-set thickness in the whole of the seaming area, eliminating the possibility of accidents because of handling failure and the possible deterioration of the part support cradle or the tools in case of collision.

All this is possible thanks to the said mechanical stops and their system of work force limitation or regulation.

Two stops are used for each operation, so as to provide the maximum stability to the headstock and therefore to achieve a greater guarantee of uniformity or evenness in the thickness of the seamed part.

The situation of the stops (15, 16) on the fixed part, and their corresponding counter-stops suitably integrated into the mobile slide and into the tool holder plate (38, 39), allow the headstock to operate even without tools, which means a substantial advantage both in operation and in make ready.

The actions and situation of the double stops can be appreciated in FIGS. 7, 8, 9, 13, 14, 15, 16, 17, 18, 19, 20, 25, 26, 27 and 28, which show perfectly the said fixed stops (15, 16) for seaming and pre-seaming respectively, on the base plate of the slide and the mobile stops (38) for pre-seaming, on the tool holder plate (10), and more specifically on prolongation of the latter and below its turning axis (11), and (39) for seaming, situated on the prolongation on the slide (6).

The double stops can be situated either in the upper area, for the cases of external seaming, or in the lower area, for, internal seaming.

Figure 3:
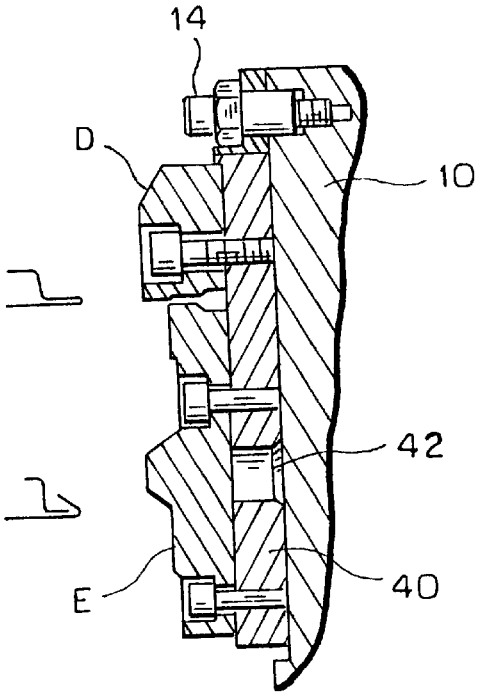
FIGS. 3 to 6 illustrate several details of the different tools used, in accordance with the invention.
Figure 4:
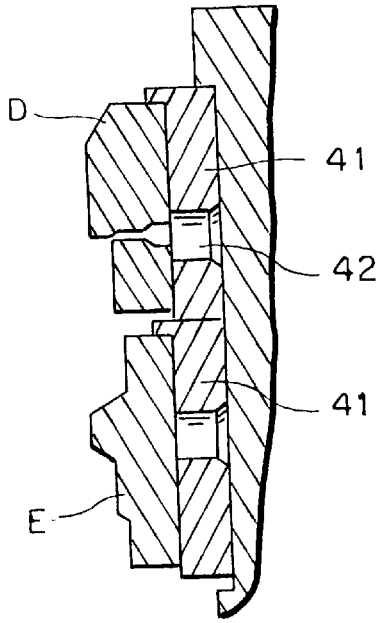
Figure 5:
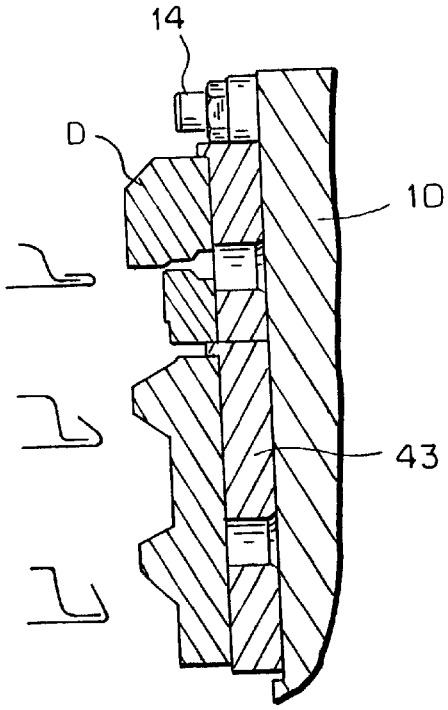
Figure 6:
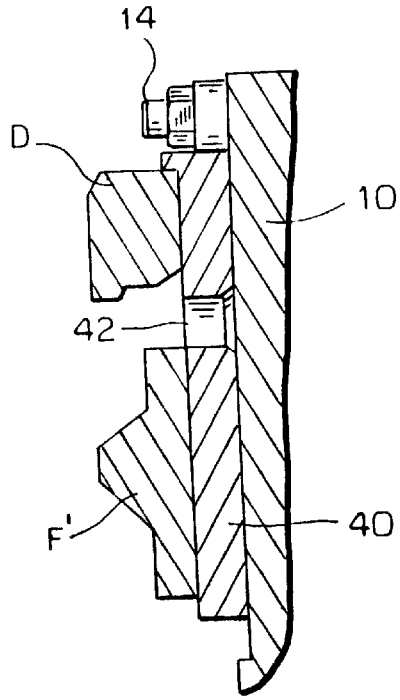

As regards the tools, FIGS. 3 to 6, there can be two (D, E)—FIGS. 3 and 4, in order to carry out the seaming in two operations, or three (D, E, F)—FIG. 5, it the seaming takes place in three operations, all for vertical contours, whereas the tools (D, P') are for chamfered contours.

The tools can be mounted on a common support plate (40) with height regulation through the eccentric stop (14) and reference holes (42), for the first and second operations illustrated in FIG. 3.

They can also be tools, as shown in FIG. 4, for the first and second operations, on different support plates (41) without height regulation, as well as, FIG. 5, for the two preparatory operations on a common plate (43) and another second plate for the finishing operation, with height regulation.

On the other hand, the action of the dolly plates (4) is emphasized, on which the tool holder plate is supported when it is located in the work position, preventing the support shaft (11) and the rotation bushings from receiving work loads.

As regards FIGS. 9, 10 and 10A, a brief mention must be made about the two possibilities of transmission in terms of the position required for the servomotor.

Thus, in accordance with FIG. 10, the servomotor (25) is shown, with the coupling by means of a hub, towards an end conical pinion, that engages with a conical toothed crown gear and transmits movement to a ball bearing screw spindle (28).

In accordance with FIG. 10A, the vertical servomotor (25) is connected to the servomotor (59) that operates the toothed pulley (58), the toothed crown gear (57) and the toothed pulley (58'), all so as to transmit the movement to the screw spindle (28).

The mechanical circuit of system forces is optimum, given that all the parts, except one, work under compression, and the size of the circuit is small. Only the mobile slide (6) works under traction and flexion combined, and is suitably proportioned for this purpose These characteristics enable the assembly to have much greater rigidity than other systems currently used.

Another outstanding characteristic of the invention is that it permits the streamlining or protection in the operating area, mobile parts, due to to fact that the system does not have more than a relative tilting of the area for the tools, complying with standard EN.292 for the protection and safety of persons when carrying out loading and unloading operations manually.

Moreover due to its configuration, it enables a machine height, as well as an external contour distance, suitable for the carrying out of the said loading and unloading operations manually.

Finally, it is necessary to emphasis that other advantageous objectives are achieved by the object of the invention, such as the following:

The possibility of situating the headstocks in any position that the part to be seamed requires.

The mechanical stops are integrated independently of the tools.

The system is modular, given that it accepts several sizes for the headstock.

What is claimed is:

1. A modular seaming device for connecting together metallic parts (A, B), the device comprising:

a base plate (2);

a cradle (1) mounted to the base plate (2) to support the parts (A, B) to be connected together;

at least one seaming headstock having a pair of supports (5) fixed to the base plate (2), a first slide (6) slidable through the base plate (2) on two side guides (7) respectively engaged in opposing grooves on the supports (5) and at least one tool holder plate (10) for holding at least one group of tools for connecting the parts (A,B) engaged on the first slide (6);

wherein the tool holder plate (10) is rotatable at a bottom edge around a transverse shaft (11) by a first drive system which drives a second slide (13) slidable on the first slide (6) to actuate a connecting link (12) engaged to an upper edge of the tool holder plate (10) to move the tool holder plate (10) toward or away from the cradle (1); and a second drive system for moving the first slide (6) up and down through the base plate (2) fixed to an underside of the base plate (2).

2. A modular seaming device for connecting together metallic parts (A, B), the device comprising:

a base plate (2);

a cradle (1) mounted to the base plate (2) to support the parts (A, B) to be connected together;

at least one seaming headstock having a pair of supports (5) fixed to the base plate (2), a first slide (6) slidable through the base plate (2) on two side guides (7) respectively engaged in opposing grooves on the supports (5) and at least one tool holder plate (10) for holding at least one group of tools for connecting the parts (A,B) engaged on the first slide (6);

wherein the tool holder plate (10) is rotatable at a bottom edge around a transverse shaft (11) by a first drive system which drives a second slide (13) slidable on the first slide (6) to actuate a connecting link (12) engaged to an upper edge of the tool holder plate (10) to move the tool holder plate (10) toward or away from the cradle (1);

a second drive system for moving the first slide (6) up and down through the base plate (2) fixed to an underside of the base plate (2); and wherein the second drive system is a hydraulic cylinder (19) fixed to the base plate (2) having a piston rod engaged to a pusher plate engaging the first slide (6).

3. A modular seaming device for connecting together metallic parts (A, B), the device comprising:

a base plate (2);

a cradle (1) mounted to the base plate (2) to support the parts (A, B) to be connected together;

at least one seaming headstock having a pair of supports (5) fixed to the base plate (2), a first slide (6) slidable through the base plate (2) on two side guides (7) respectively engaged in opposing grooves on the supports (5) and at least one tool holder plate (10) for holding at least one group of tools for connecting the parts (A,B) engaged on the first slide (6);

wherein the tool holder plate (10) is rotatable at a bottom edge around a transverse shaft (11) by a first drive system which drives a second slide (13) slidable on the first slide (6) to actuate a connecting link (12) engaged to an upper edge of the tool holder plate (10) to move the tool holder plate (10) toward or away from the cradle (1);

a second drive system for moving the first slide (6) up and down through the base plate (2) fixed to an underside of the base plate (2); and wherein the first drive system includes a cam shaft and cam follower connected to an arm which is connected to the second side (13) by means of an elastic system.

4. The modular seaming device according to claim 1, further comprising synchronizing means engaged to the first drive and second drive to synchronize the movement of the first slide (6) and the second slide (13).

5. The modular seaming device according to claim 1, further comprising a plurality of mechanical stops (15, 16) engaged on the base plate (2) and mobile stops on the first slide (6) to absorb impact of the tool holder plate (10) during connection of the metallic parts (A,B).

6. The modular seaming device according to claim 1, further comprising a locking means for locking movement of the device comprising a pin (53) which is selectively passed through different holes in the headstock and the first slide (6).

7. The modular seaming device according to claim 1, wherein the first drive system comprises a pneumatic cylinder (17) fixed to the first slide (6) having a piston rod engaged to a pusher plate engaging the second slide (13); and an electric motor (21) having a main shaft (22) with a cam (46) that operates a pneumatic distributor (47) that actuates the pneumatic cylinder (17).

8. The modular seaming device according to claim 1, wherein the first drive system comprises an electric motor (21) having a main shaft (22) with a first conical gear (48) that operates a second conical gear fixed on one end of a cam follower (50) which actuates the second slide (13).

9. A modular seaming device for connecting together metallic parts (A, B), the device comprising:

a base plate (2);

a cradle (1) mounted to the base plate (2) to support the parts (A, B) to be connected together;

at least one seaming headstock having a pair of supports (5) fixed to the base plate (2), a first slide (6) slidable through the base plate (2) on two side guides (7) respectively engaged in opposing grooves on the supports (5) and at least one tool holder plate (10) for holding at least one group of tools for connecting the parts (A,B) engaged on the first slide (6);

wherein the tool holder plate (10) is rotatable at a bottom edge around a transverse shaft (11) by a first drive system which drives a second slide (13) slidable on the first slide (6) to actuate a connecting link (12) engaged to an upper edge of the tool holder plate (10) to move the tool holder plate (10) toward or away from the cradle (1);

a second drive system for moving the first slide (6) up and down through the base plate (2) fixed to an underside of the base plate (2);

synchronizing means engaged to the first drive and second drive to synchronize the movement of the first slide (6) and the second slide (13);

a plurality of mechanical stops (15, 16) engaged on the base plate (2) and mobile stops on the first slide (6) to absorb impact of the tool holder plate (10) during connection of the metallic parts (A,B);

a locking means for locking movement of the device comprising a pin (53) which is selectively passed through different holes in the headstock and the first slide (6);

wherein the first drive system comprises a pneumatic cylinder (17) fixed to the first slide (6) having a piston rod engaged to a pusher plate engaging the second slide (13); and an electric motor (21) having a main shaft (22) with a cam (46) that operates a pneumatic distributor (47) that actuates the pneumatic cylinder (17).

10. A modular seaming device for connecting together metallic parts (A, B), the device comprising:

a base plate (2);

a cradle (1) mounted to the base plate (2) to support the parts (A, B) to be connected together;

at least one seaming headstock having a pair of supports (5) fixed to the base plate (2), a first slide (6) slidable through the base plate (2) on two side guides (7) respectively engaged in opposing grooves on the supports (5) and at least one tool holder plate (10) for holding at least one group of tools for connecting the parts (A,B) engaged on the first slide (6);

wherein the tool holder plate (10) is rotatable at a bottom edge around a transverse shaft (11) by a first drive system which drives a second slide (13) slidable on the first slide (6) to actuate connecting link (12) engaged to an upper edge of the tool holder plate (10) to move the tool holder plate (10) toward or away from cradle (1);

a second drive system for moving the first slide (6) up and down through the base plate (2) fixed to an underside of the base plate (2);

synchronizing means engaged to the first drive and second drive to synchronize the movement of the first slide (6) and the second slide (13);

a plurality of mechanical stops (15, 16) engaged on the base plate (2) and mobile stops on the first slide (6) to absorb impact of the tool holder plate (10) during connection of the metallic parts (A,B);

a locking means for locking movement of the device comprising a pin (53) which is selectively passed through different holes in the headstock and the first slide (6); and wherein the first drive system comprises an electric motor (21) having a main shaft (22) with a first conical gear (48) that operates a second conical gear fixed on one end of a cam follower (50) which actuates the second slide (13).

* * * * *